US005159638A

United States Patent [19]

Naito et al.

[11] Patent Number: 5,159,638

[45] Date of Patent: Oct. 27, 1992

[54] SPEECH DETECTOR WITH IMPROVED LINE-FAULT IMMUNITY

[75] Inventors: Yushi Naito, Kamakura; Kazuo Saito, Amagasaki, both of Japan

[73] Assignee: Mitsubishi Denki Kabushiki Kaisha, Tokyo, Japan

[21] Appl. No.: 544,591

[22] Filed: Jun. 27, 1990

[30] Foreign Application Priority Data

Jun. 29, 1989 [JP] Japan ..... 1-167586

[51] Int. Cl.[5] ..... G10L 5/00

[52] U.S. Cl. ..... 381/46; 381/47

[58] Field of Search ..... 381/46, 47; 370/80, 370/81

[56] References Cited

U.S. PATENT DOCUMENTS 3,712,959 1/1973 Fariello .
3,985,956 10/1976 Monti et al. .
4,001,505 1/1977 Araseki et al. .
4,061,878 12/1977 Adoul et al. .

OTHER PUBLICATIONS

Casale, et al, IEEE Global Telecommunications Conference and Exhibition, Hollywood, FL, "A DSP implemented . . . discriminator" Nov. 28–Dec. 1, 1988, vol. 3, pp. 1419–1427.

"A Highly Sensitive Speech Detector and High-Speed Voiceband Data Discriminator in DSI-ADPCM Systems" Y. Yatsuzuka, IEEE Transactions on Communications, vol. COM-30, No. 4, Apr. 1982.

"Pattern Recognition Approach to Voiced-Unvoiced-Silence Classification with Applications to Speech Recognition." B. S. Atal and L. R. Rabiner, IEEE Transactions on Acoustics, Speech, and Signal Processing, vol. ASSP-24, No. 3, Jun. 1976.

*Primary Examiner*—Emanuel S. Kemeny

[57] ABSTRACT

A speech detector has an intensity detector that indicates whether the intensity of a PCM signal exceeds a first threshold, and a normal-zero-crossing-count detector that indicates whether the zero-crossing count of the PCM signal exceeds a second threshold. The outputs of the intensity detector and normal-zero-crossing-count detector are combined by AND logic to produce the output of the speech detector. The second threshold is set well below the minimum zero-crossing count occurring in normal speech, the function of the normal-zero-crossing-count detector being to disable speech detection during line faults.

18 Claims, 9 Drawing Sheets

SPEECH DETECTOR WITH IMPROVED LINE-FAULT IMMUNITY

BACKGROUND OF THE INVENTION

This invention relates to a speech detector for determining the presence or absence of speech in a pulse-code-modulation (PCM) signal, more particularly to a speech detector with improved immunity to line faults. The invented speech detector is applicable in, for example, digital speech interpolation (DSI) equipment, digital channel multiplication equipment (DCME), and voice packetization equipment.

DSI, DCME, and voice packetization equipment utilize telephone channels efficiently by transmitting only those segments of a PCM-encoded signal in which speech is present, as determined by a speech detector. Prior-art speech detectors generally detect speech when the intensity level of the PCM signal, variously defined as the mean power, mean amplitude, or peak value of the signal over an interval of time, is above a certain threshold. To detect low-intensity speech, the speech detector may also test the zero-crossing count, defined as the number of sign changes of the PCM signal within the interval, and combine the intensity and zero-crossing detection results by OR logic. That is, speech is detected as present if either the intensity level or the zero-crossing count is over a respective threshold.

Line faults occur for a variety of reasons, ranging from equipment malfunctions to breakdown of transmission cables, between the site of origin of a signal and the input terminal of the speech detector, producing PCM signals that contain no meaningful speech information. To avoid the wasteful allocation of channels to or assembly of voice packets by such signals, when a line fault occurs, the speech detector should detect speech as absent.

Line faults, however, tend to create PCM signals with large direct-current offsets. For example, when a PCM signal is relayed by PCM primary-group multiplex equipment as stipulated in recommendation G.732, "Characteristics of Primary PCM Multiplex Equipment Operating at 2048 kbit/s," of the International Telegraph and Telephone Consultative Committee (CCITT), a line fault causes the transfer of an Alarm Indication Signal (AIS), as stipulated in Section 4.2 in the above recommendation, comprising eight-bit code words consisting of all one's (11111111). In the A-law PCM code used in PCM primary-group multiplex transmission systems, the code word 11111111 denotes an amplitude of approximately 2.6% the maximum amplitude that can be transmitted. Even a sinewave signal of this amplitude should easily exceed the intensity threshold for speech detection regardless of whether peak detection, mean-power detection, or mean-amplitude detection is used.

Existing speech detectors therefore tend to mistake line faults for the presence of speech, causing unnecessary allocation of channels or assembly of voice packets, thereby reducing channel utilization efficiency.

SUMMARY OF THE INVENTION

An object of the present invention is accordingly to discriminate correctly between speech and line faults.

The invented speech detector comprises an intensity detector for producing a first Boolean signal that is true if the intensity of a PCM signal exceeds a first threshold and false if it does not, a zero-crossing counter for counting sign changes in the PCM signal and producing a zero-crossing count, a normal-zero-crossing-count detector for producing a second Boolean signal that is true if the zero-crossing count exceeds a second threshold and false if it does not, and an AND gate for taking the logical AND of the first and second Boolean signals.

DETAILED DESCRIPTION OF THE INVENTION

Speech detectors embodying the present invention will be described with reference to block diagrams in FIGS. 1 to 6. These diagrams and the accompanying descriptions exemplify the invention but are not intended to restrict its scope, which should be determined solely according to the appended claims.

Figure 1:
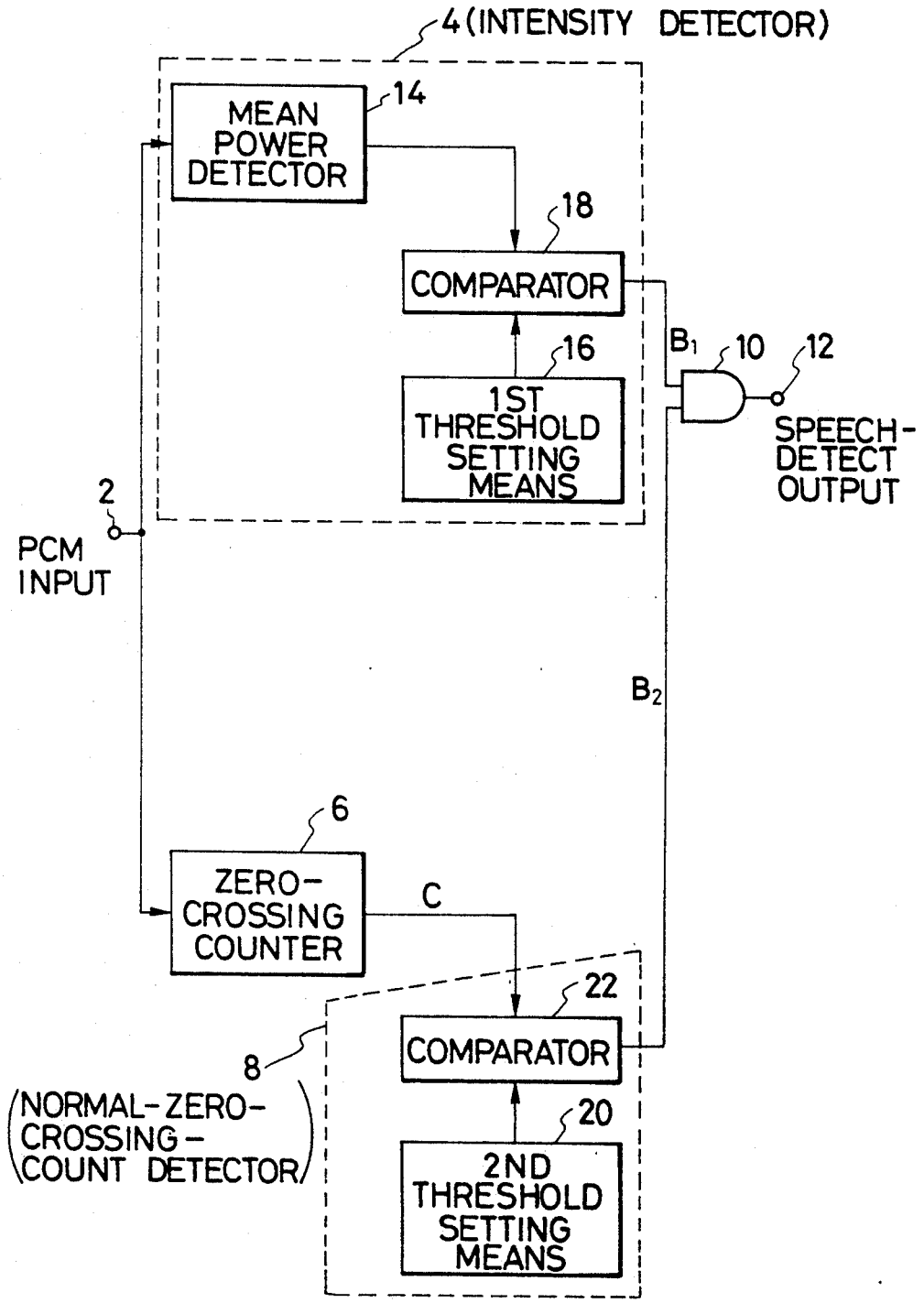
FIG. 1 is a block diagram of a first speech detector embodying the present invention.

A first speech detector, illustrated in FIG. 1, comprises an input terminal 2, an intensity detector 4, a zero-crossing counter 6, a normal-zero-crossing-count detector 8, an AND gate 10, and an output terminal 12.

The input terminal 2 receives an input PCM signal comprising a series of digital sample values, which it supplies to the intensity detector 4 and the zero-crossing counter 6.

The intensity detector 4 compares the intensity of the PCM signal with a first threshold and produces a first Boolean signal $B_1$ that is true if the intensity exceeds the first threshold and false if the intensity does not exceed the first threshold. The true value is thus indicative of the presence of speech while the false value is indicative of the absence of speech, but as noted earlier, true values may also be produced by line faults.

The term Boolean signal in these descriptions and the appended claims refers to a signal having two states, such as a high voltage level and a low voltage level, of which one state denotes the Boolean value "true" and the other state denotes the Boolean value "false."

The intensity detector 4 in FIG. 1 comprises a mean-power detector 14, a first threshold-setting means 16, and a first comparator 18. The mean-power detector 14 is a computing device that receives the PCM signal from the input terminal 2 and calculates the mean-square value of the the PCM samples over a certain interval of time, hereinafter referred to as a block. Thus for each block, the mean-power detector 14 produces a digital value representing the mean-square value of the PCM signal in that block.

The first threshold-setting means 16 is any device that can be set to produce a fixed value as the first threshold, such as a rotary switch, a slide switch, a keypad input device, or a register in a computing device.

The first comparator 18 is a computing device that receives the mean-square value of each signal block from the mean-power detector 14 and compares it with the first threshold value, which it receives from the first threshold-setting means 16. The first comparator 18 sets the first Boolean signal $B_1$ to the true state if the mean-square value exceeds the first threshold, and to the false state if the mean-square value does not exceed the first threshold.

The zero-crossing counter 6 is a computing device that receives the input PCM signal from the input terminal 2 and counts sign changes occurring in the PCM signal, thus producing a zero-crossing count C. More specifically, the zero-crossing counter 6 counts the number of times the sign bit (the most significant bit) of the PCM signal changes between successive of sample values in a block.

The normal-zero-crossing-count detector 8 receives the zero-crossing count C from the zero-crossing counter 6, compares the zero-crossing count C with a second threshold, and produces a second Boolean signal $B_2$ that is true when the zero-crossing count C exceeds the second threshold and false when the zero-crossing count C does not exceed the second threshold. The second threshold is preferably set to a value such as zero that is well below the minimum zero-crossing count occurring in normal speech. The false value of the second Boolean signal $B_2$ thus indicates the definite absence of speech, while the true value indicates the possible but not definite presence of speech. The second threshold can be small enough that even normal background noise in the PCM signal makes the second Boolean signal $B_2$ true.

The normal-zero-crossing-count detector 8 in FIG. 1 comprises a second threshold-setting means 20 and a second comparator 22. The second threshold-setting means 20 is a switch or register similar to, but independent of, the first threshold-setting means 16. The second comparator 22 is a computing device that receives the zero-crossing count C from the mean-power detector 14, compares it with the second threshold value received from the second threshold-setting means 20, and sets the second Boolean signal $B_2$ to the true or false state according to whether the zero-crossing count C does or does not exceed the second threshold.

The AND gate 10 receives the first Boolean signal $B_1$ from the intensity detector 4 and the second Boolean signal $B_2$ from the normal-zero-crossing-count detector 8, takes the logical AND of these two signals, and sends the result to the output terminal 12 as the output of the speech detector. The AND gate 10 can be any two-input Boolean device that produces a true output when both inputs are true and a false output if either input is false. For example, the AND gate 10 can be a standard AND logic circuit, or simply a switch turned on or off under control of the second Boolean signal $B_2$, thereby passing or blocking the first Boolean signal $B_1$.

The speech detector in FIG. 1 can be built using digital switches, logic gates, and other standard components. Alternatively, the components in FIG. 1 can be integrated into a digital signal processor comprising a single semiconductor chip.

In this speech detector the main function of speech detection is performed by the intensity detector 4, the role of the normal-zero-crossing-count detector 8 being to disable the output of the intensity detector 4 when a line fault occurs.

When a normal PCM signal is received, the intensity detector 4 identifies the presence or absence of speech according to the mean-power value and sets the first Boolean signal $B_1$ accordingly. If the second threshold has a properly low value, then a normal PCM signal, either a background noise signal or an active speech signal, is present, the second Boolean signal $B_2$ will be true. Thus when speech is present, both the first Boolean signal $B_1$ and the second Boolean signal $B_2$ will be true, so the output of the AND gate 10 will be true. When speech is absent, the first Boolean signal $B_1$ will be false, so the output of the AND gate 10 will be false. DSI equipment, DCME, or voice packetization equipment can thus allocate channels to or assemble packets by the PCM signal on the basis of this output, which is provided at the output terminal 12.

When a line fault occurs, due to the resulting large direct-current offset of the PCM signal, the second Boolean signal $B_2$ will generally be false. If the line fault produces a PCM signal comprising a string of 11111111 code words as described earlier, for example, since no sign changes occur the zero-crossing count C is zero. Zero does not exceed the second threshold, so the second Boolean signal $B_2$ is false and the output of the AND gate 10 is false, regardless of the value of the first Boolean signal $B_1$. DSI equipment, DCME, or voice packetization equipment employing this speech detector will therefore not allocate unnecessary channels to or assemble packets by PCM signal blocks representing line faults.

Figure 2:
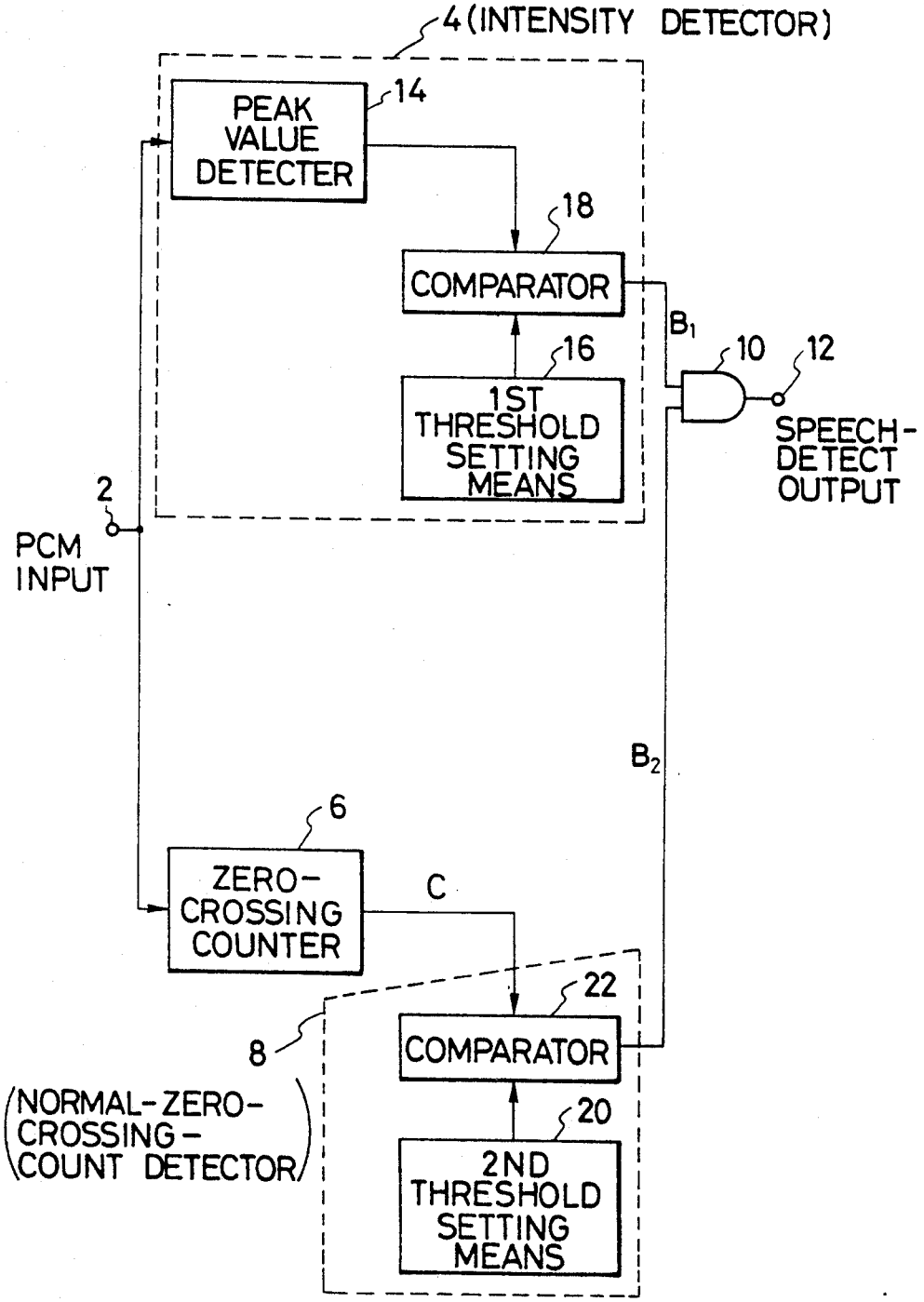
FIG. 2 is a block diagram of a second speech detector embodying the present invention.

FIG. 2 shows a second speech detector embodying this invention. This speech detector is identical to the first speech detector shown in FIG. 1 except that the intensity detector 4 employs the peak value detection of the PCM signal instead of its mean power detection. A peak-value detector 24 is therefore used in place of the mean-power detector 14 in FIG. 1. The other elements in FIG. 2 are identical to elements in FIG. 1 having the same reference numerals.

The peak-value detector 24 in FIG. 2 receives the PCM signal and produces as output for each PCM signal block the peak value of the PCM signal in that block. The peak value is supplied to the first comparator 18, which compares it with the first threshold received from the first threshold-setting means 16 to generate the first Boolean signal $B_1$. The rest of the operation is the same as in FIG. 1, so further description is omitted. As before, the normal-zero-crossing-count detector 8 disables the output of the intensity detector 4 during line faults.

Figure 3:
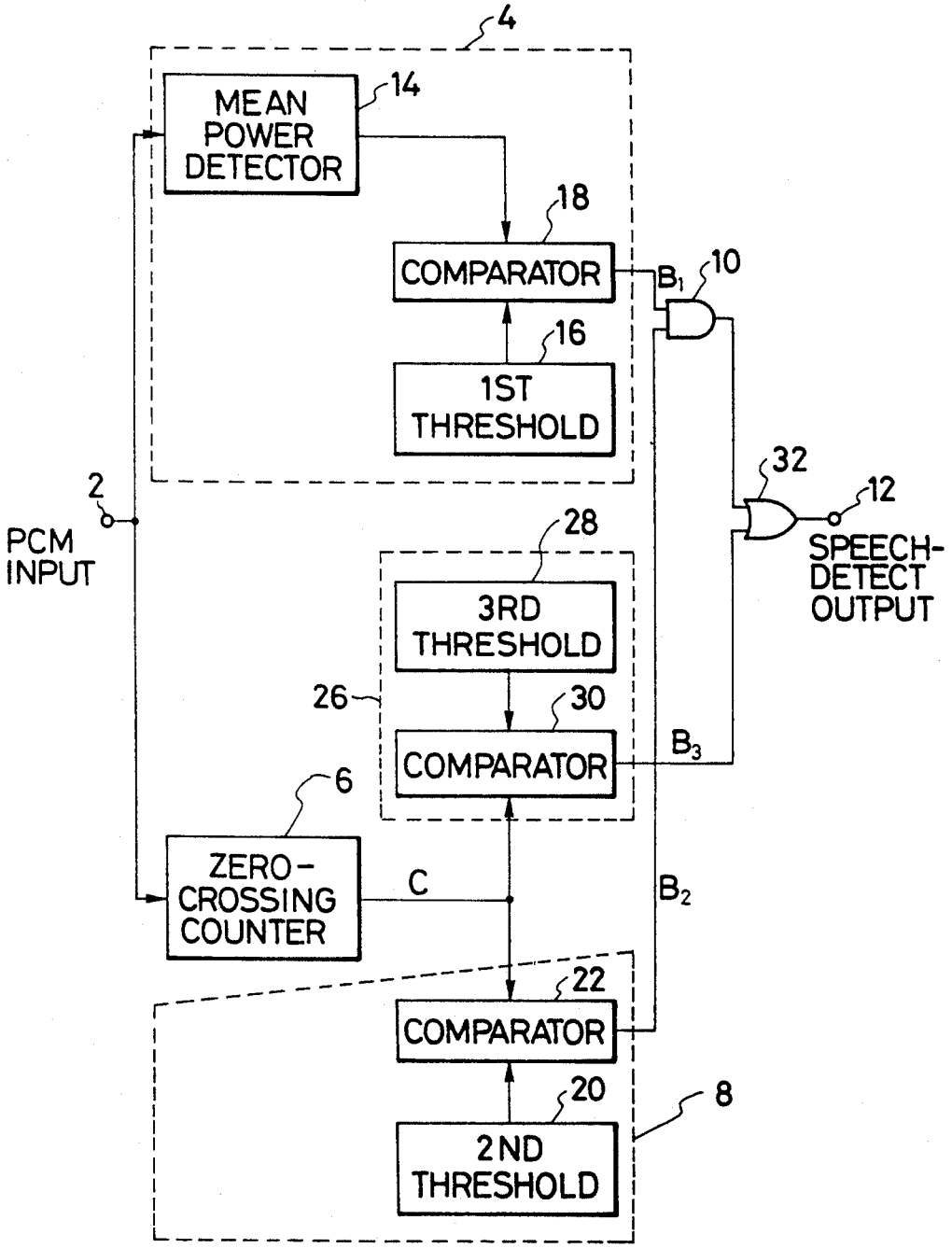
FIG. 3 is a block diagram of a third speech detector embodying the present invention.

A third speech detector, comprising the speech detector of FIG. 1 with an additional high-zero-crossing-count detector, is illustrated in FIG. 3. Elements having the same reference numerals in FIGS. 1 and 3 are identical; descriptions will be omitted.

The high-zero-crossing-count detector 26 in FIG. 3, which comprises a third threshold-setting means 28 and a third comparator 30, is coupled to the zero-crossing counter, receives the zero-crossing count C, and generates a third Boolean signal $B_3$. The third threshold-setting means 28, which is similar to but independent of the first threshold-setting means 16 and the second threshold-setting means 20, set a third threshold that is higher than the second threshold sets by the second threshold-setting means 20. The third comparator 30 compares the zero-crossing count C with the third threshold, sets the third Boolean signal $B_3$ to the true state if the zero-crossing count C exceeds the third threshold, and sets the third Boolean signal $B_3$ to the false state if the zero-crossing count C does not exceed the third threshold. The third threshold should be high enough that the true value of the third Boolean signal $B_3$ indicates the definite presence of speech.

The third Boolean signal $B_3$ is supplied as one input of a two-input OR gate 32, the othe input of which is the output of the AND gate 10. The OR gate 32 takes the logical OR of the third Boolean signal $B_3$ and the output of the AND gate 10 and sends the result to the output terminal 12 as the output of the speech detector.

When a normal speech signal is received, the intensity detector 4 and the normal-zero-crossing-count detector 8 operate as in FIG. 1, making the output of the AND gate 10 true or false according to the presence or absence of speech. Certain normal-intensity speech sounds, such as fricatives at the beginnings of utterances, have a mean-power value below the first threshold, causing the first Boolean signal $B_1$ and the output of the AND gate 10 to be false. These speech sounds can be detected by the high-zero-crossing-count detector 26, however, making the third Boolean signal $B_3$ true. Since the output of the OR gate 32 is true when either the third Boolean signal $B_3$ or the output of the AND gate 10 is true, the signal at the output terminal 12 correctly indicates the presence of both normal-intensity and low-intensity speech.

When a line fault occurs, the second Boolean signal $B_2$ is false as already described, so the output of the AND gate 10 is false. Since the third threshold is higher than the second threshold, the third Boolean signal $B_3$ is also false. Thus both inputs to the OR gate 32 are false, so the output at the output terminal 12 is false and channels are not allocated or packets are not assembled unnecessarily.

The same effect can be obtained by reversing the order of the AND and OR gates in FIG. 3, so that the first Boolean signal $B_1$ is ORed with the third Boolean signal $B_3$, then the result is ANDed with the second Boolean signal $B_2$.

Figure 4:
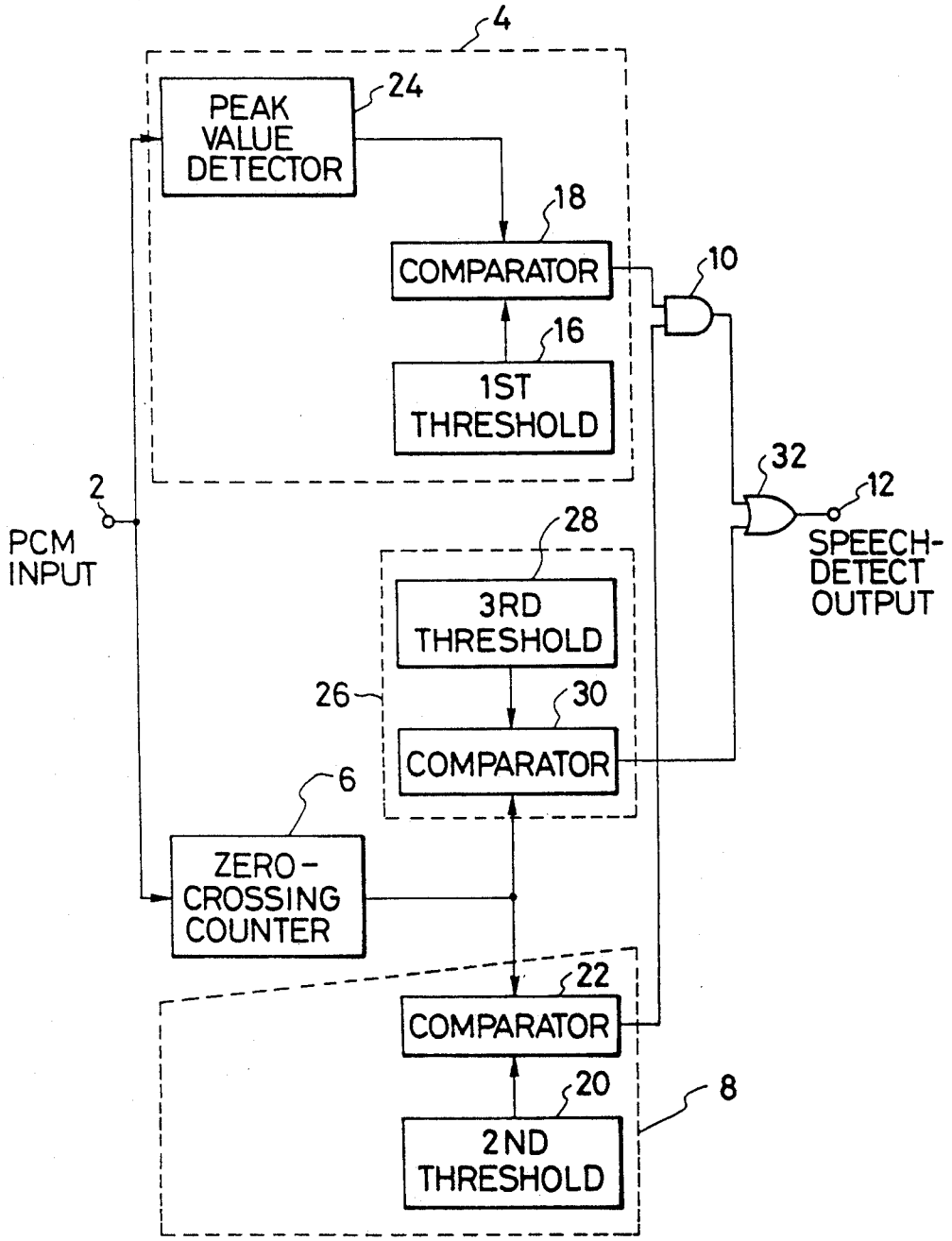
FIG. 4 is a block diagram of a fourth speech detector embodying the present invention.

FIG. 4 shows a fourth speech detector empoying a peak-value detector 24 in place of the mean-power detector 14 in FIG. 3. Aside from this difference, the speech detector in FIG. 4 is identical in operation to the one in FIG. 3.

Figure 5:
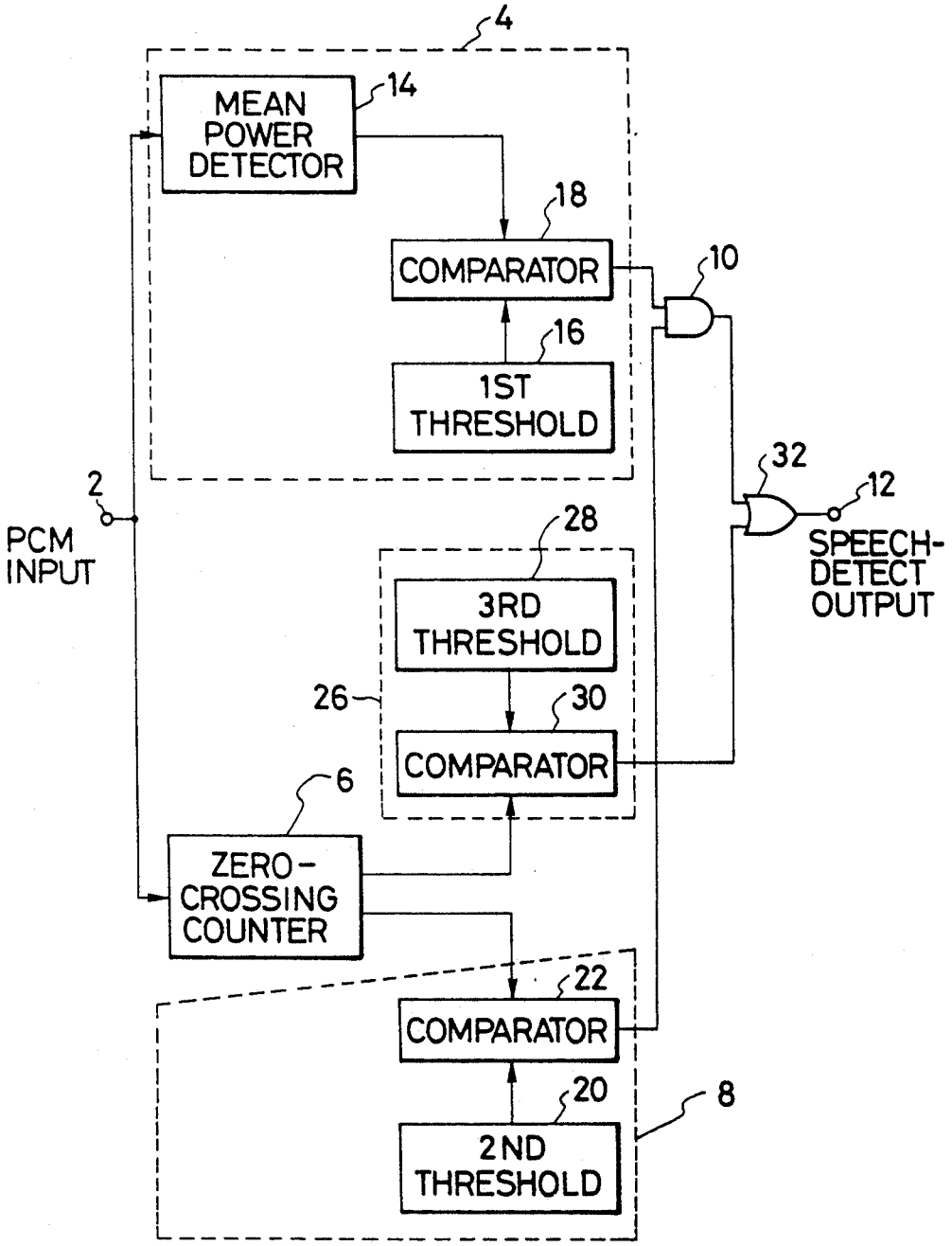
FIG. 5 is a block diagram of a fifth speech detector embodying the present invention.

FIG. 5 shows a fifth speech detector which is similar to the one in FIG. 3 except that the zero-crossing counter 6 supplies separate zero-crossing counts $C_1$ and $C_2$ to the normal-zero-crossing-count detector 8 and the high-zero-crossing-count detector 26. These counts have different block lengths: the zero-crossing count $C_2$ supplied to the high-zero-crossing-count detector 26 is counted over shorter intervals of time than the zero-crossing count $C_1$ supplied to the normal-zero-crossing-count detector 8. By using a short first block time, the high-zero-crossing-count detector 26 can quickly detect low-intensity sounds at the beginning of utterances, thus avoiding speech clipping effects. By using a longer second block time, the normal-zero-crossing-count detector 8 can distinguish accurately between line faults and possible speech, thus preventing unnecessary channel allocation or packet assembly.

Figure 6:
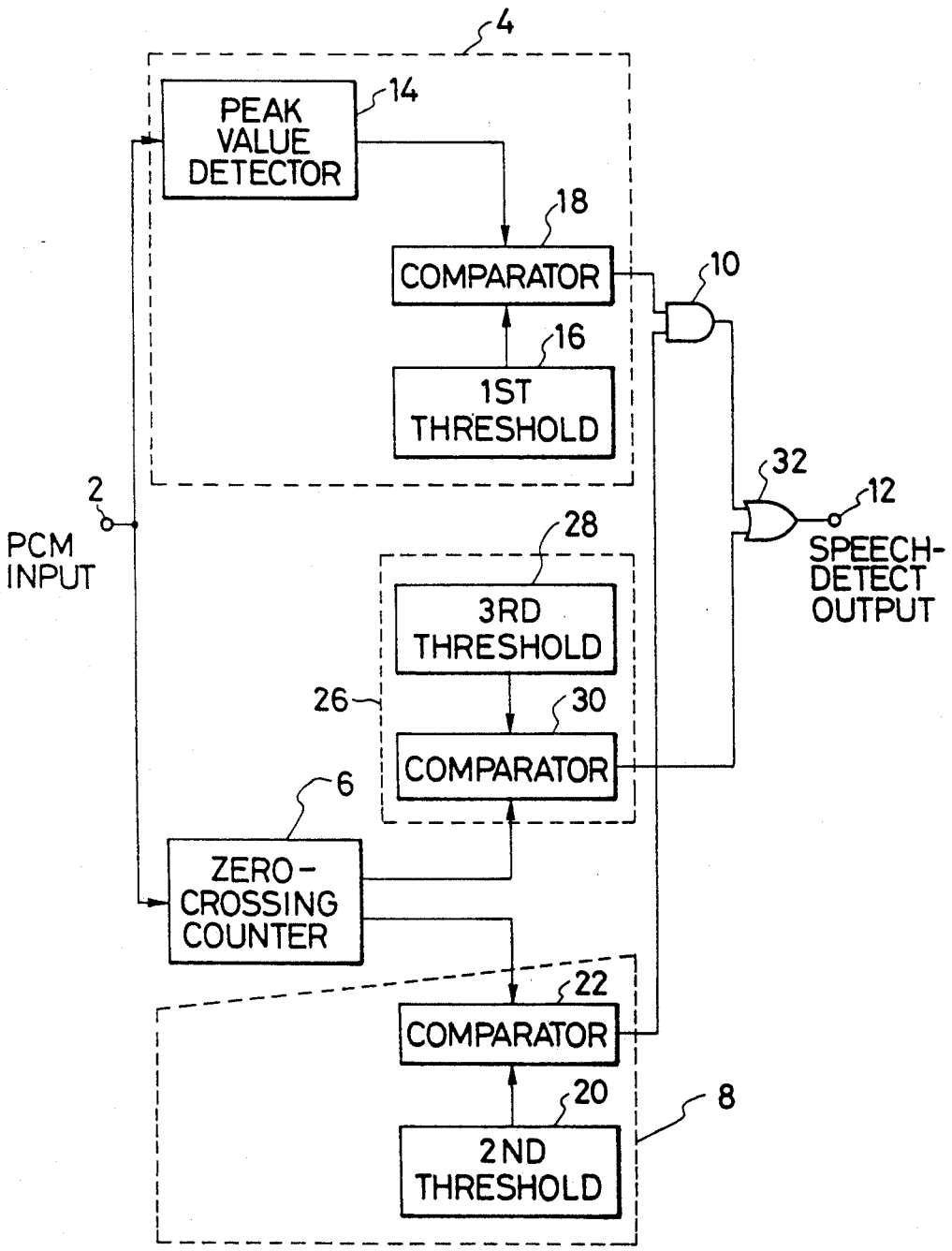
FIG. 6 is a block diagram of a sixth speech detector embodying the present invention.

FIG. 6 shows a sixth speech detector identical to the one in FIG. 5 except that it uses a peak-value detector 24 instead of a mean-power detector. The operation of this speech detector will be obvious from the foregoing descriptions.

Figure 7:
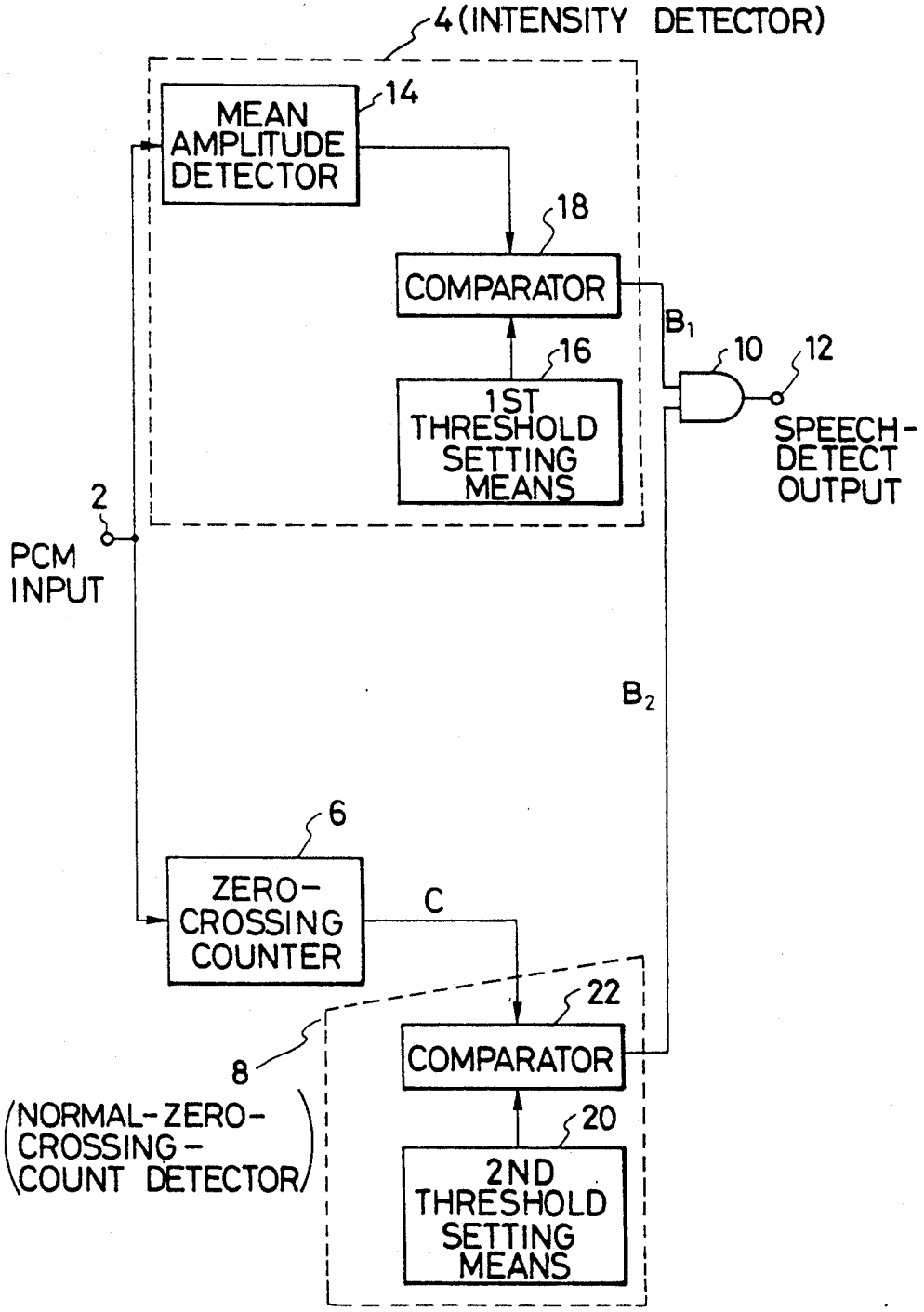
FIG. 7 is a block diagram of a seventh speech detector embodying the present invention.
Figure 8:
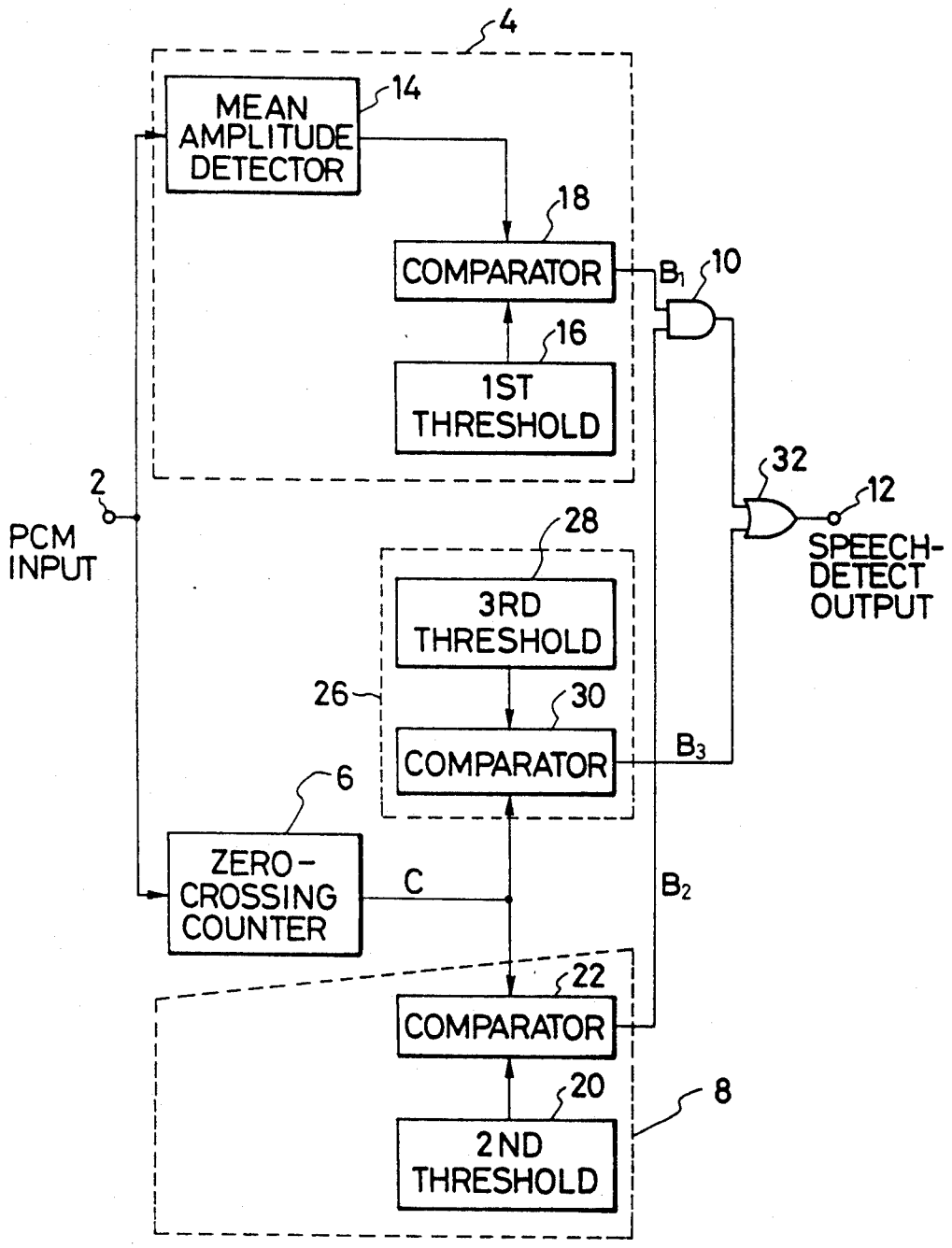
FIG. 8 is a block diagram of an eighth speech detector embodying the present invention.
Figure 9:
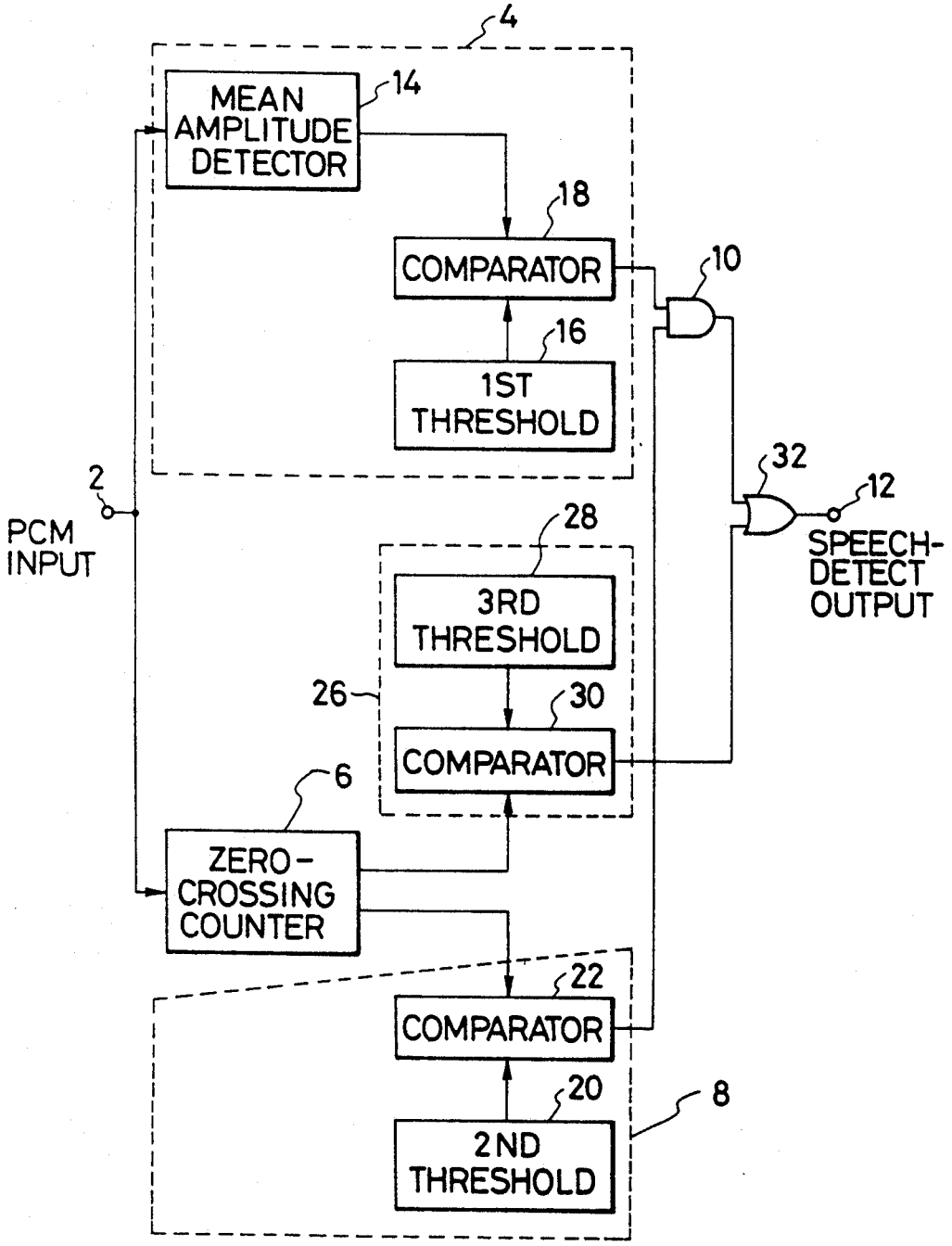
FIG. 9 is a block diagram of a ninth speech detector embodying the present invention.

Other speech detectors, similar to the ones described above, can be constructed by substituting, as shown in FIG. 7, FIG. 8 and FIG. 9, a mean-amplitude detector 34 for the mean-power detectors 14 in FIG. 1, FIG. 3 and FIG. 5, or the peak-value detectors 24 in FIG. 2, FIG. 4 and FIG. 6. The mean-amplitude detector 34 detects the means amplitude of the PCM signal over a certain interval (block) of time. Speech detectors employing mean-amplitude detectors operate in the same way as speech detectors employing mean-power or peak-value detectors, so further description is omitted.

Instead of mean power, peak value, or mean amplitude, other measures of signal intensity can also be used in the intensity detector 4.

What is claimed is:

1. A speech detector for discriminating between line faults and speech in a PCM signal, in order to improve communication channel utilization efficiency, comprising:

intensity detecting means for comparing the intensity of the PCM signal with a first threshold and producing a first Boolean signal that is true if the intensity exceeds the first threshold, indicating a possible presence of line faults or speech in the PCM signal, and false if the intensity fails to exceed the first threshold, indicating the presence of background noise;

zero-crossing counting means for counting sign changes in the PCM signal, thereby producing a zero-crossing count;

normal-zero-crossing-count detecting means, coupled to said zero-crossing counting means, for comparing the zero-crossing count with a second threshold and porducing a second Boolean siganl that is true if the zero-crossing count exceeds the second threshold, indicating the PCM signal includes speech and normal background noise, and false if the zero-crossing count fails to exceed the second threshold, indicating a code word having a large direct-current offset indicating a line fault is present in the PCM signal; and ANDing means, coupled to said intensity detecting means and said normal-zero-crossing-count detecting means, for generating the logical AND of the first Boolean signal and the second Boolean signal, and producing a third Boolean signal that is true when speech is present in the PCM signal, and false when no speech is present in the PCM signal, thereby improving communication channel utilization efficiency of a communication system.

2. The detector of claim 1, said normal-zero-crossing-count detecting means, including, threshold-setting means for setting the second threshold, and comparing means, coupled to said zero-crossing counting means and said threshold-setting means, for comparing the zero-crossing count with the second threshold.

3. The detector of claim 1, wherein the intensity of the PCM signal is the mean-square value of the PCM signal over predetermined interval of time.

4. The detector of claim 1, wherein the intensity of the PCM signal is the peak value of the PCM signal over a predetermined interval of time.

5. The detector of claim 1, further comprising:

high-zero-crossing-count detecting means, coupled to said zero-crossing counting means, for comparing the zero-crossing count with a third threshold, higher than the second threshold and producing a fourth Boolean signal that is true if the zero-crossing count exceeds the third threshold, indicating speech is present in the PCM signal and false otherwise; and Oring means, coupled to said ANDing means and said high-zero-crossing-count detecting means, for taking the logical OR of the fourth Boolean signal and the third Boolean signal and producing a fifth Boolean signal that is true when speech is present in the PCM signal and false when no speech is present in the PCM signal, thereby improving communication channel utilization efficiency of the communication system.

6. The detector of claim 5, wherein said zero-crossing counting means supplies said normal-zero-crossing-count detecting means with zero-crossing counts over a first predetermined interval of time and supplies said high-zero-crossing-count detecting means with zero-crossing counts over a second predetermined interval of time, longer than the first predetermined interval of time.

7. The detector of claim 1, where the intensity of the PCM signal is the mean amplitude of the PCM signal over a predtermined interval of time.

8. The detector of claim 1, said code word having a large direct-current offset is a code word consisting of string of all one's.

9. The detector of claim 1, wherein said first threshold is selected as to be exceeded by a speech signal, and not to be exceeded by normal background noise.

10. The detector of claim 1, wherein said zero-crossing counting means counts the sign changes in a predetermined time period, and said second threshold is set to be zero.

11. The detector of claim 1, wherein said zero-crossing counting means counts the sign changes over a predetermined time period.

12. The detector of claim 11, wherein said predetermined time period is a time period between successive sample values in a block.

13. A method for discriminating beween line faults and speech in a PCM signal, in order to improve communication channel utilization efficiency, comprising the steps of:

(a) comparing the intensity of the PCM signal with a first threshold and producing a first Boolean signal that is true if the intensity exceeds the first threshold, indicating a possible presence of line faults or speech in the PCM signal, and false otherwise;

(b) counting sign changes in the PCM signal, thereby producing a zero-crossing count;

(c) comparing the zero-crossing count with a second threshold and producing a second Boolean signal that is true if the zero-crossing count exceeds the second threshold and false otherwise, indicating speech is not present in the PCM signal; and (d) generating the logical AND of the first Boolean signal and the second Boolean signal, and producting a third Booleans signal that is true when speech is present in the PCM signal, and false when no speech is present in the PCM signal, thereby improving communication channel utilization efficiency of a communication system.

14. The method of claim 13, wherein the intensity of the PCM signal is the mean square value of the PCM signal over a predetermined interval of time.

15. The method of claim 13, wherein the intensity of the PCM signal is the peak value of the PCM signal over a predetermined interval of time.

16. The method of claim 13, further comprising the steps of:

(e) comparing the zero-crossing count with a third threshold, higher than the second threshold, and producing a fourth Boolean signal that is true if the zeroo-crossing count exceeds the third threshold, indicating speech is present in the PCM signal and false otherwise; and (f) generating the logical OR of the fourth Boolean signal and the third Boolean signal and producing a fifth Boolean signal that is true when speech is present in the PCM signal and false when no speech is present in the PCM signal, thereby improving communication channel utilization efficiency of the communication system.

17. The method of claim 16, wherein said step (b), the zero-crossing count provided to step (c) is performed over a first predetermined interval of time, and a second zero-crossing count is provided to said step (e), performed over a second predetermined interval of time, longer than the first predetermined interval of time.

18. The method of claim 13, where the intensity of the PCM signal is the mean amplitude of the PCM signal over a predetermined interval of time.

* * * * *